US012042689B2

(12) United States Patent
Leipheimer et al.

(10) Patent No.: US 12,042,689 B2
(45) Date of Patent: Jul. 23, 2024

(54) COMBINATION ATTACHMENT HANDLE

(71) Applicant: Specialty Fitness Systems, LLC, Franklin, PA (US)

(72) Inventors: Jerry K. Leipheimer, Sharpsville, PA (US); Kassem Edward Hanson, Longmont, CO (US)

(73) Assignee: Specialty Fitness Systems, LLC, Franklin, PA (US)

( * ) Notice: Subject to any disclaimer, the term of this patent is extended or adjusted under 35 U.S.C. 154(b) by 133 days.

(21) Appl. No.: 17/622,441

(22) PCT Filed: Jun. 25, 2020

(86) PCT No.: PCT/US2020/039582
§ 371 (c)(1),
(2) Date: Dec. 23, 2021

(87) PCT Pub. No.: WO2020/264135
PCT Pub. Date: Dec. 30, 2020

(65) Prior Publication Data

US 2022/0395716 A1 Dec. 15, 2022

Related U.S. Application Data

(60) Provisional application No. 62/866,877, filed on Jun. 26, 2019.

(51) Int. Cl.
*A63B 21/00* (2006.01)
*A63B 23/035* (2006.01)

(52) U.S. Cl.
CPC .... *A63B 21/4019* (2015.10); *A63B 23/03508* (2013.01); *A63B 23/03516* (2013.01)

(58) Field of Classification Search
CPC ..... A63B 23/03508; A63B 23/03516; A63B 21/4017; A63B 21/4019; A63B 21/4021; A63B 21/4033; A63B 21/4035
See application file for complete search history.

(56) References Cited

U.S. PATENT DOCUMENTS 3,415,515 A * 12/1968 Otto ..... A63B 5/20 482/129
3,995,650 A * 12/1976 DiVito ..... A61H 3/02 16/DIG. 30

(Continued)

FOREIGN PATENT DOCUMENTS

CN 2912701 Y 6/2007
CN 202096653 U 1/2012

OTHER PUBLICATIONS

Perform Better, Perform Better Contour Rubber Cable Handle, Published: Mar. 10, 2016, <URL: https://a.co/d/ba1cSY3> (Year: 2016).*

*Primary Examiner* — Zachary T Moore
(74) *Attorney, Agent, or Firm* — The Webb Law Firm

(57) ABSTRACT

An attachment handle for an exercise machine includes a flexible tension member, a first ring secured to a first end of the flexible tension member, a second ring secured to a second end of the flexible tension member, and a hand grip having a bore surrounding the flexible tension member. The hand grip is slideable along the flexible tension member between the first and second rings. The hand grip defines a first shoulder at a first end of the hand grip and a second shoulder at a second end of the hand grip.

18 Claims, 8 Drawing Sheets

(56) References Cited

U.S. PATENT DOCUMENTS 4,784,391 A * 11/1988 Herron ..... A63B 67/10 473/576
4,941,232 A * 7/1990 Decker ..... B25F 5/006 473/301
5,643,149 A * 7/1997 Grimaldi ..... A63B 5/20 482/122
7,473,213 B1 1/2009 Kallenbach
7,662,073 B1 * 2/2010 Baldwin ..... A63B 21/4001 482/92
7,691,040 B1 * 4/2010 Schwinghamer ..... A63B 21/00 482/106
8,403,818 B1 3/2013 Wilkinson et al.
8,556,784 B2 * 10/2013 Leibowitz ..... A63B 21/4025 482/121
8,696,527 B2 * 4/2014 Wu ..... A63B 21/1663 482/131
8,894,556 B2 * 11/2014 Webb ..... A63B 21/075 482/126
9,370,685 B2 6/2016 Watry
9,526,943 B2 12/2016 Emick
9,757,604 B2 9/2017 Carter
9,855,456 B2 1/2018 Dorsey et al.
9,987,512 B1 6/2018 Romfo
2004/0082448 A1 4/2004 Martin
2006/0030465 A1 2/2006 Johnson et al.
2008/0040891 A1 2/2008 Tyler
2010/0113234 A1 5/2010 Kristiansen
2012/0329620 A1 * 12/2012 White ..... A63B 23/1236 482/131
2013/0005544 A1 1/2013 Butler et al.
2013/0178345 A1 * 7/2013 Wu ..... A63B 21/4043 482/139
2014/0073495 A1 * 3/2014 Anderson ..... A63B 21/4035 24/129 R
2014/0228180 A1 8/2014 Walker
2014/0274602 A1 9/2014 Autogue
2015/0057136 A1 2/2015 Dorsey et al.
2017/0050074 A1 2/2017 Olson
2017/0296860 A1 * 10/2017 Watry ..... A63B 21/4035

* cited by examiner

COMBINATION ATTACHMENT HANDLE

CROSS-REFERENCE TO RELATED APPLICATIONS

This application is the United States national phase of International Application No. PCT/US2020/039582 filed Jun. 25, 2020, and claims the benefit of U.S. Provisional Patent Application No. 62/866,877 filed Jun. 26, 2019, the disclosures of which are hereby incorporated by reference in their entirety.

BACKGROUND OF THE INVENTION

Field of the Invention

This disclosure relates generally to attachment handles for cable exercise machines and, more particularly, to a combination attachment handle transitionable between multiple grip arrangements.

Description of Related Art

Exercise machines which employ a cable attached to a counterweight or other resistive element are well known. Conventionally, such exercise machines include a handle fixed or removably attached to an end of the cable. The handle may be, for example, a D-handle, rope handle, or saddle handle. A user must exert a force on the handle to overcome the resistance of the resistive element and move the cable through a predetermined range of motion.

Depending on the exercise movement performed, the user may desire a particular type and/or arrangement of handle to optimize the force exerted and/or target specific muscles. More particularly, the user may choose a handle which orients the arm, wrist, and hand at a desired position relative to the cable and to the rest of the user's body.

While many varieties of handles exist to provide the user with a broad range of options for performing exercise movements, a user must often completely detach the handle and replace it with a different handle in order to perform a different exercise movement. In addition to wasting time, this requires the user to keep a large number of different handles on hand.

In view of the foregoing, there exists a need for an attachment handle which can be arranged for multiple grip positions suitable for a variety of exercise movements.

SUMMARY OF THE INVENTION

Embodiments of the present disclosure are directed to an attachment handle for an exercise machine including a flexible tension member, a first ring secured to a first end of the flexible tension member, a second ring secured to a second end of the flexible tension member, and a hand grip having a bore surrounding the flexible tension member. The hand grip is slideable along the flexible tension member between the first and second rings. The hand grip defines a first shoulder at a first end of the hand grip and defines a second shoulder at a second end of the hand grip.

In some non-limiting embodiments, the hand grip includes a tapered gripping surface such that a circumference of the gripping surface decreases toward one of the first or second ends of the hand grip.

In some non-limiting embodiments, at least one of the first ring and the second ring comprises a clasp to allow removal of the ring from the tension member.

In some non-limiting embodiments, the hand grip includes a first flange located at the first end of the hand grip, and a second flange located at the second end of the hand grip.

In some non-limiting embodiments, the flexible tension member is foldable about the hand grip such that openings of each of the first and second rings are alignable.

In some non-limiting embodiments, the flexible tension member includes a first end portion fed through an opening of the first ring and folded over against the flexible tension member, and a second end portion fed through an opening of the second ring and folded over against the flexible tension member.

In some non-limiting embodiments, the folded-over first and second end portions are secured to the flexible tension member with stitching.

In some non-limiting embodiments, the flexible tension member is a flat strip of fabric.

In some non-limiting embodiments, the first shoulder and the second shoulder are curved surfaces.

In some non-limiting embodiments, the first shoulder and the second shoulder are beveled surfaces.

Other embodiments of the present disclosure are directed to a cable exercise machine including a clip and a first attachment handle including a flexible tension member, a first ring secured to a first end of the flexible tension member, a second ring secured to a second end of the flexible tension member, and a hand grip having a bore surrounding the flexible tension member. The hand grip is slideable along the flexible tension member between the first and second rings. The hand grip defines a first shoulder at a first end of the hand grip and defines a second shoulder at a second end of the hand grip. The cable exercise machine further includes a second attachment handle identical to the first attachment handle. One of the rings of each of the first and second attachment handles is connected to the clip.

In some non-limiting embodiments, the hand grip of each attachment handle includes a tapered gripping surface such that a circumference of the gripping surface decreases toward one of the first or second ends of the hand grip.

In some non-limiting embodiments, at least one of the first ring and the second ring of each attachment handle comprises a clasp to allow removal of the ring from the tension member.

In some non-limiting embodiments, the gripping surface of each attachment handle is tapered such that a circumference of the gripping surface decreases in a direction away from the clip.

In some non-limiting embodiments, the hand grip of each attachment handle includes a first flange located at the first end of the hand grip, and a second flange located at the second end of the hand grip.

In some non-limiting embodiments, the flexible tension member of each attachment handle includes a first end portion fed through an opening of the first ring and folded over against the flexible tension member, and a second end portion fed through an opening of the second ring and folded over against the flexible tension member.

In some non-limiting embodiments, the folded-over first and second end portions of each attachment handle are secured to the flexible tension member with stitching.

In some non-limiting embodiments, the flexible tension member of each attachment handle is a flat strip of fabric.

In some non-limiting embodiments, the first shoulder and the second shoulder of each attachment handle are curved surfaces.

In some non-limiting embodiments, the first shoulder and the second shoulder of each attachment handle are beveled surfaces.

These and other features and characteristics of the combination attachment handle design will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

DESCRIPTION OF THE INVENTION

Figure 1:
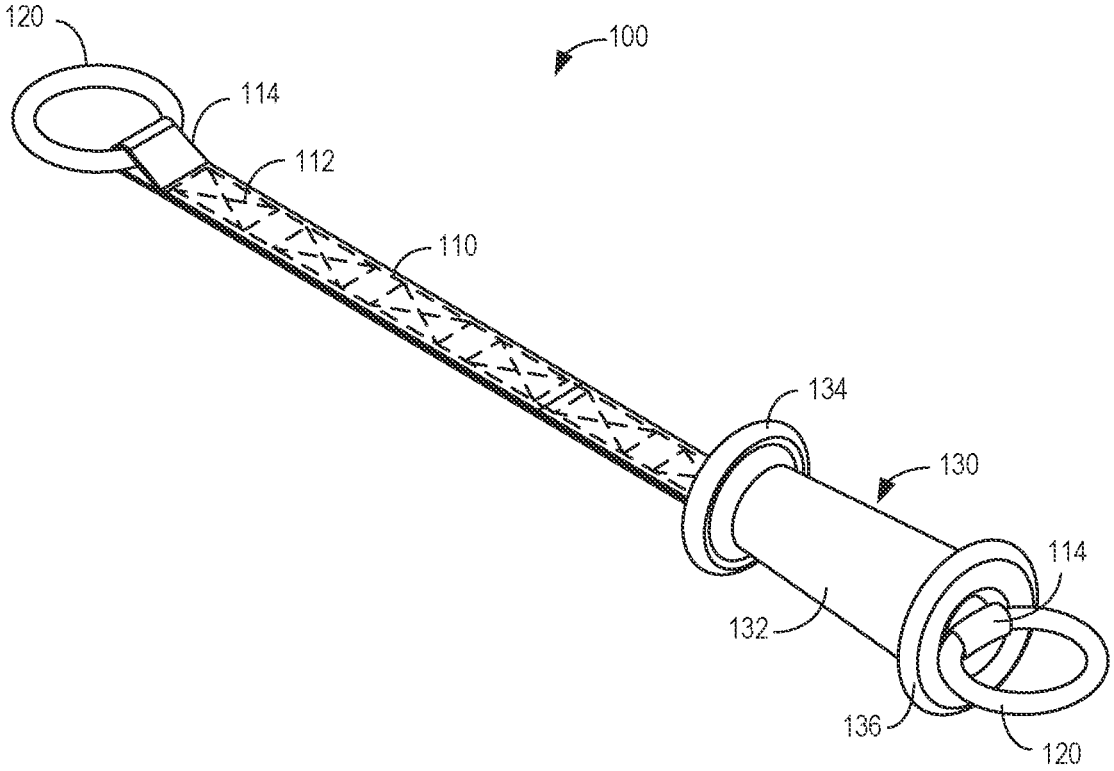
FIG. 1 is a perspective view of a cable attachment handle according to a non-limiting embodiment of the present invention, arranged in a first configuration.

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

As used herein, the term "circumference" means the distance around the outer edge of a round or polygonal shape. For example, the circumference of a circle is equal to the diameter multiplied by pi, whereas the circumference or a quadrilateral is equal to the sum of all four side lengths.

The present disclosure relates generally to attachment handles for cable exercise machines and, more particularly, to attachment handles transitionable into multiple grip arrangements.

Referring now to FIGS. 1-5, a cable attachment handle 100 includes a flexible tension member 110 with a ring 120 attached to each end thereof. A hand grip 130 surrounds a portion of the tension member 110 and is slideable along the tension member 110 between the rings 120. Each of the rings 120 may be attached to the tension member 110 by feeding an end portion 114 of the tension member 110 through the ring 120 and folding the end portion 114 back against the tension member 110. Stitching 112 may be used to secure the folded-over end portion 114 to the tension member 110 and restrain the ring 120. The rings 120 are shown as being generally circular in the accompanying drawings, but any round or polygonal shape having an opening therethrough should be regarded as being within the scope of the present disclosure. In some non-limiting embodiments, one or both of the rings 120 may have a clasp to allow removal of the ring 120 from the tension member 110. For example, one or both of the rings 120 may be a carabiner, as show in FIG. 8.

In the non-limiting embodiment shown, the tension member 110 may be a flat element such as a strip of fabric. In other embodiments, the tension member 110 may be a circular element such a rope or cord. In some non-limiting embodiments, the rings 120 may be omitted and the tension member 110 may be folded over itself at either end to form loops or eyelets in lieu of the rings 120.

Figure 2:
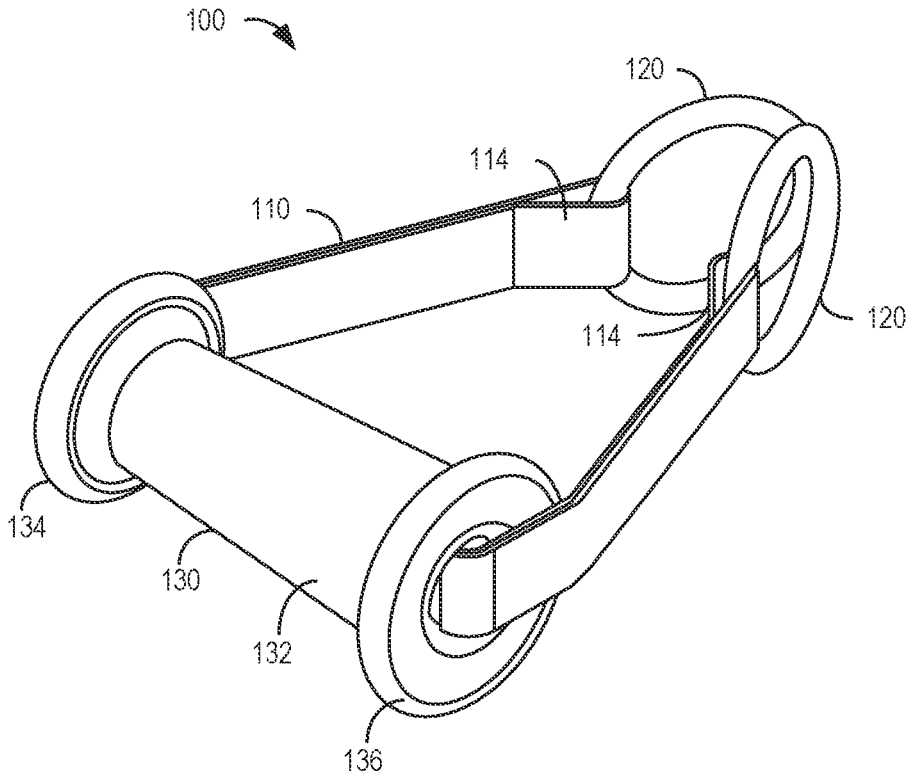
FIG. 2 is a perspective view of the cable attachment handle of G. 1, arranged in a second configuration.

With continued reference to FIG. 1, the hand grip 130 may include gripping surface 132 extending between a first flange 134 and a second flange 136. The gripping surface 132 may be tapered toward or away from either or both of the flanges 134, 136. In the non-limiting embodiment shown in FIGS. 1-2, for example, the gripping surface 132 is tapered toward the first flange 134 such that the circumference of the gripping surface 132 adjacent the first flange 134 is less than the circumference of the gripping surface 132 adjacent the second flange 136. As also illustrated in FIGS. 1-2, the gripping surface 132 may be substantially round or circular in cross section. However, the gripping surface 132 may be any shape or profile suitable for being squeezed in a user's hand. The gripping surface 132 may also include protrusions or indentations contouring to the user's hand. The gripping surface 132 may include knurling or other surface discontinuities to aid the user's grip and prevent slippage of the hand grip 130 during use.

Because the tension member 110 is flexible and the hand grip 130 is slideable along the tension member 110, the attachment handle 100 can be transitioned into multiple arrangements to facilitate different grip positions and exercise movements. In FIG. 1, the tension member 110 is positioned horizontally straight with the hand grip 130 positioned toward one of the rings 120. In FIG. 2, the hand grip 130 is positioned toward the center of the tension member 110, and the tension member 110 is folded inwardly such that the openings of the rings 120 are aligned to allow a clip or fastener to be inserted through the openings of both rings 120.

Figure 3:
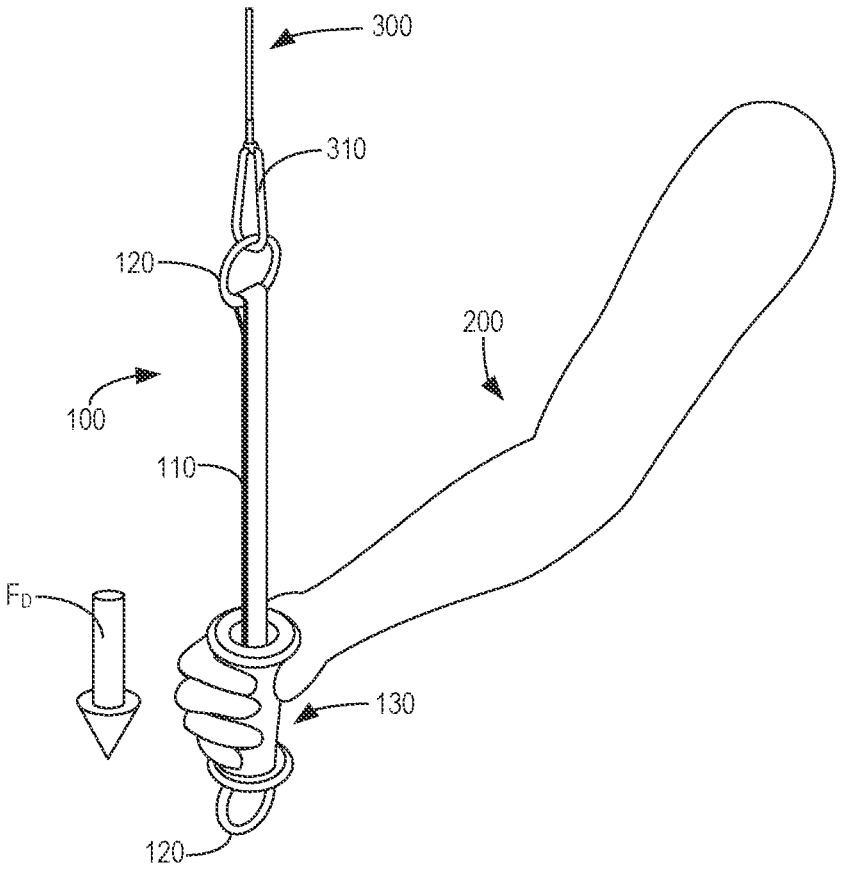
FIG. 3 is a perspective view of a user using the cable attachment handle of FIG. 1 in the first configuration for a downward pulling movement.
Figure 4:
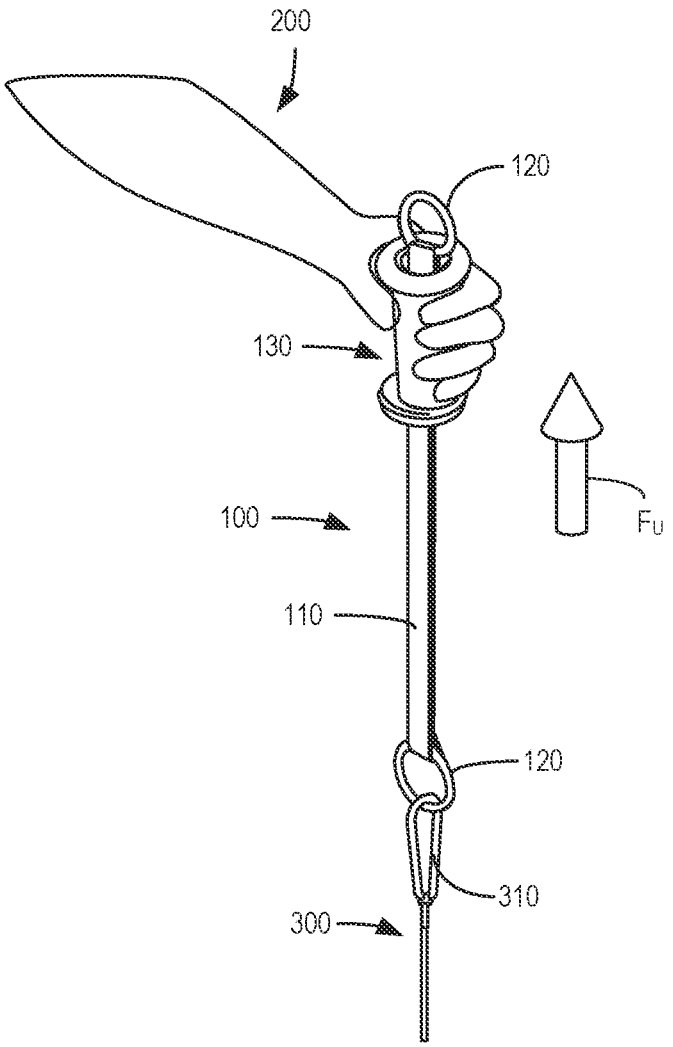
FIG. 4 is a perspective view of a user using the cable attachment handle of FIG. 1 in the first configuration for an upward pulling movement.

Referring now to FIGS. 3-6, the attachment handle 100 is shown in various orientations for use in different exercise movements and/or grip positions. In FIG. 3, the tension member is in a straight, extended position, with the hand grip 130 slid toward one of the rings 120. The ring 120 farthest from the hand grip 130 is connected to a clip 310 or similar mechanism of a cable exercise machine 300. The user 200 exerts a downward force $F_D$ on the hand grip 130 to pull on the cable exercise machine 300 to move a counterweight or other resistive element (not shown). FIG. 4 is similar to FIG. 3 except that the user 200 exerts an upward force Fu on the hand grip 130 to pull on the cable exercise machine 300. In the orientation of FIG. 3 or 4, the hand grip 130 may be positioned such that the gripping surface 132 is tapered either with or against the direction of the pulling force $F_D$, $F_L$. If the gripping surface 132 is tapered with the direction of the pulling force $F_D$, $F_L$ such that the circumference of the gripping surface 132 is greater nearer the clip 310, increased grip strength is required to prevent the hand grip 130 from slipping through the user's hand. As such, orienting the attachment handle 100 such that the gripping surface 132 tapers with direction of the pulling force $F_D$, $F_L$ may be used to train grip strength.

Figure 5:
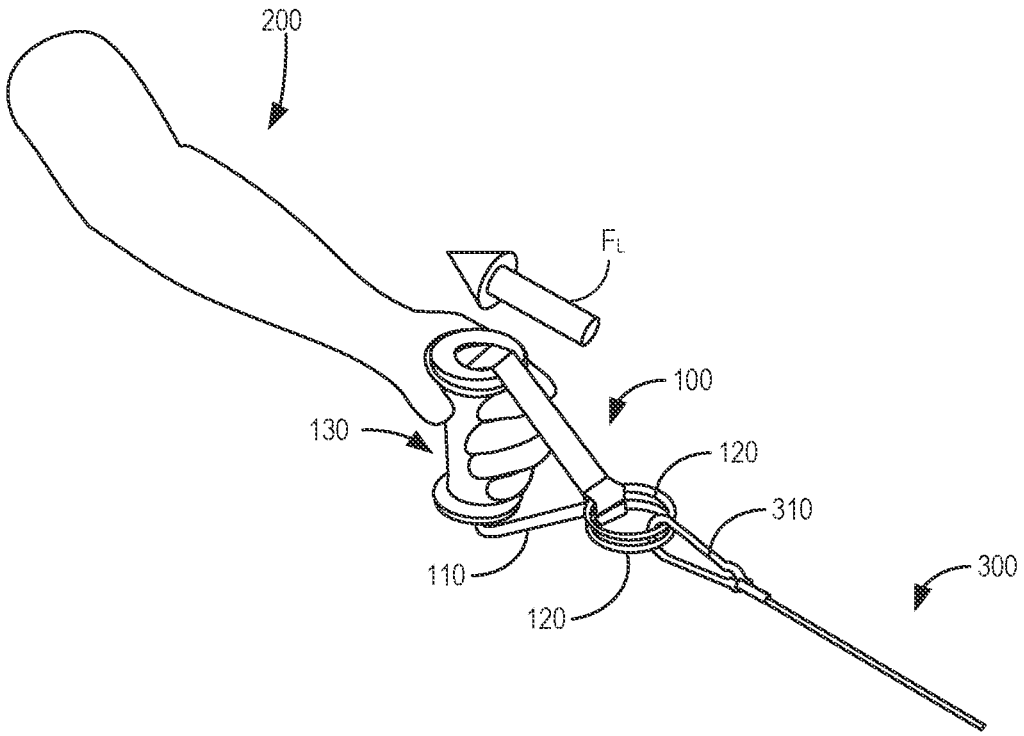
FIG. 5 is a perspective view of a user using the cable handle of FIG. 1 in the second configuration for a lateral pulling movement.

Referring now to FIG. 5, the attachment handle 100 is oriented with the ends of the tension member 110 folded inwardly toward themselves such that the openings of the rings 120 are in operative alignment and the clip 310 may be attached to both of the rings 120. The user 200 may exert a lateral force $F_L$ on the hand grip 130 to pull on the cable exercise machine 300.

Figure 6:
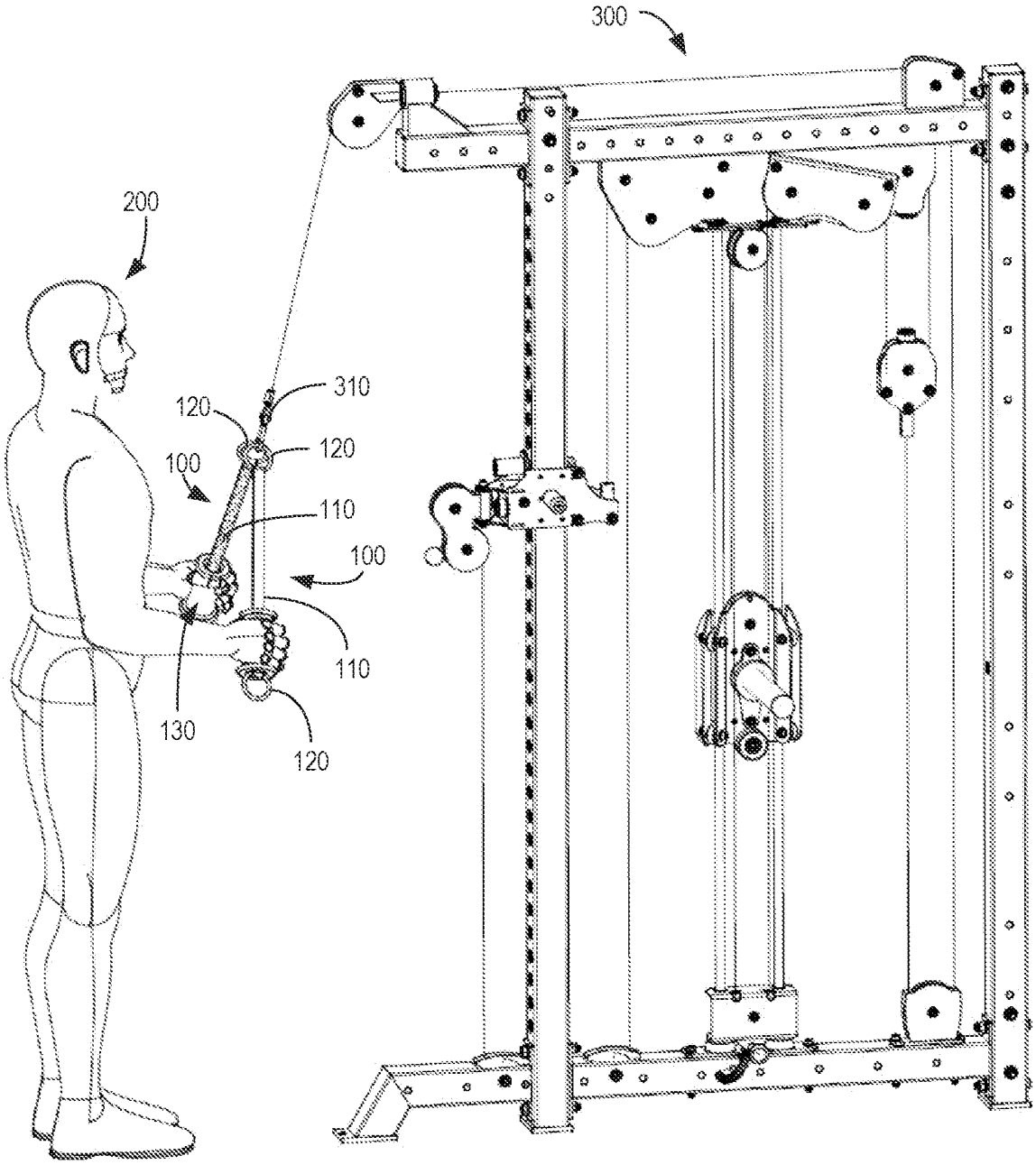
FIG. 6 is a perspective view of two of the cable attachment handles of FIG. 1 attached to a cable exercise coaching and arranged in a third configuration.

FIG. 6 illustrates an orientation of the attachment handle similar to that of FIG. 3, with two attachment handles 100 attached to the clip 310 of the exercise machine 300 to allow the user 200 to perform two-armed exercise movements.

Figure 7:
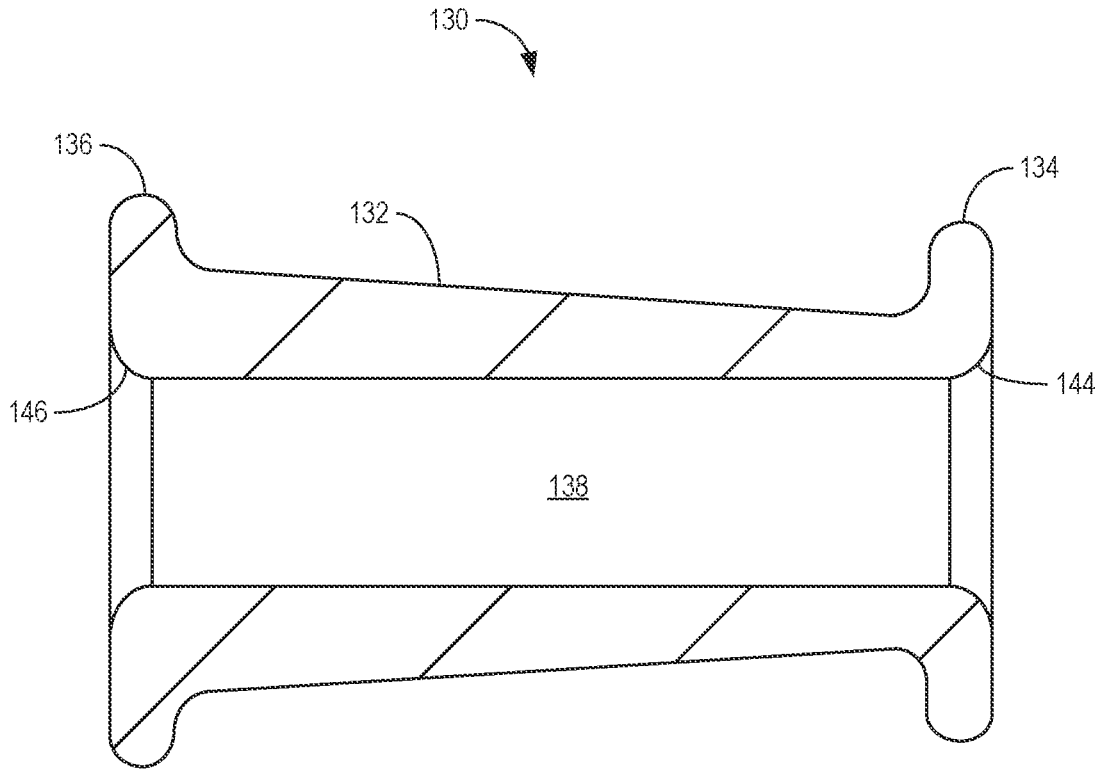
FIG. 7 is a side cross-section view of a hand grip of the cable attachment handle of FIG. 1.

Referring now to FIG. 7, the hand grip 130 is shown in cross section to illustrate the particular features thereof. The gripping surface 132 surrounds a bore 138 through which the tension member 110 (not shown in FIG. 7) extends. The hand grip 130 may define a first shoulder 144 adjacent the first flange 134 at a first end of the hand grip 130, and a second shoulder 146 adjacent the second flange 136 at a second end of the hand grip 130. Each of the shoulders 144, 146 may be a curved surface as shown in FIG. 7, a beveled surface, a stepped surface, or simply the outermost portion of the bore 138. The shoulders 144, 146 engage the rings 120 as the hand grip 130 is slid along the tension member 110, providing positive stops to prevent the rings 120 from being pulled through the hand grip 130 during use. That is, the first shoulder 144 prevents one of the rings 120 from being pulled through the hand grip 130 in a direction toward the second flange 136. Similarly, the second shoulder 146 prevents the other of the rings 120 from being pulled through the hand grip 130 in a direction toward the first flange 136.

Figure 8:
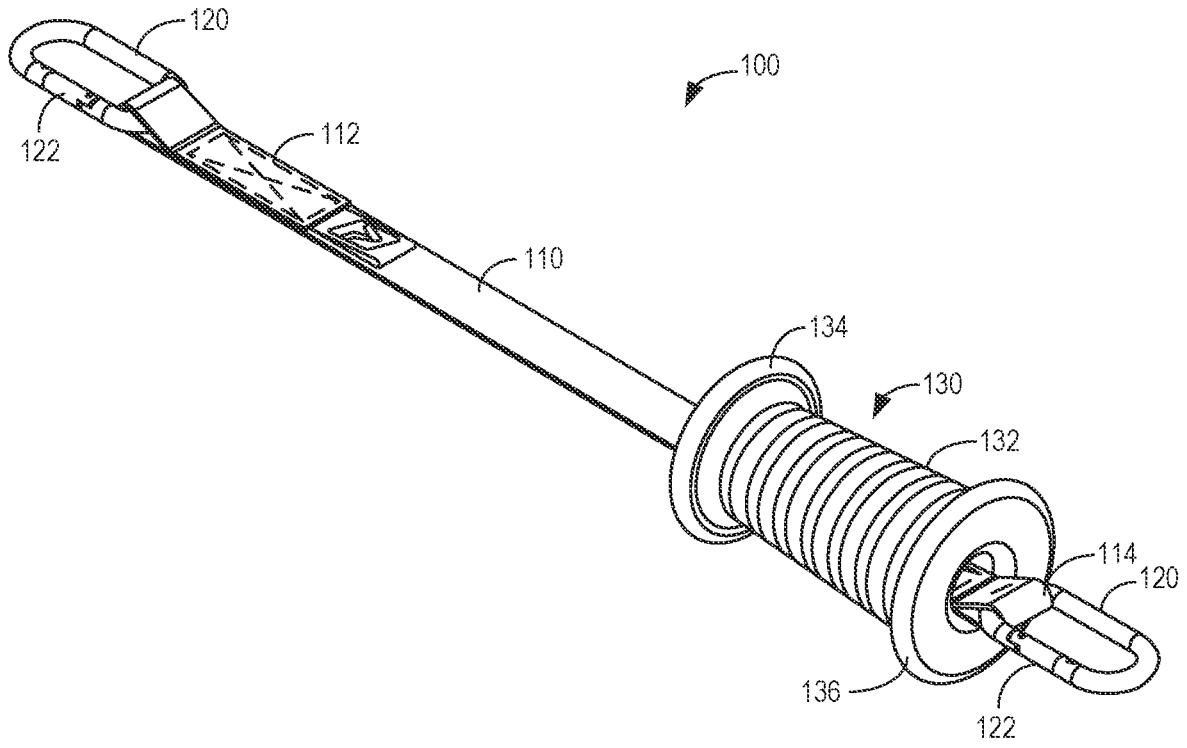
FIG. 8 is a perspective view of a cable attachment handle according to another non-limiting embodiment of the present invention, arranged in the first configuration.

Referring now to FIG. 8, in some non-limiting embodiments, one or both of the rings 120 may include a clasp 122 to allow removal of the ring 120 from the tension member 110. The clasp 122 of each ring 120 may be spring-loaded towards a closed position to prevent accidental disengagement of the ring from the tension member 110. Each ring 120 with a clasp 122 may be a carabiner or similar fastening device. In additional non-limiting embodiments, one or both of the rings 120 may be or include other types of fastening devices to allow removal of the ring 120 from the tension member 110. One or both of the rings 120 may be removed from the tension member 110 to allow the hand grip 130 to be slid off of the tension member 110 for replacement.

While various aspects of the cable attachment handle 100 were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. An attachment handle for an exercise machine, comprising:

a flexible tension member;

a first ring secured to a first end of the flexible tension member;

a second ring secured to a second end of the flexible tension member; and a hand grip having a bore surrounding the flexible tension member, the bore having a constant diameter, the hand grip comprising a first flange located at a first end of the hand grip and a second flange located at a second end of the hand grip, wherein the hand grip is slideable along the flexible tension member between the first and second rings, wherein the hand grip defines a first shoulder at the first end of the hand grip adjacent to the first flange and a second shoulder at the second end of the hand grip adjacent to the second flange, and wherein the hand grip comprises a tapered gripping surface such that a circumference of the gripping surface decreases toward one of the first or second ends of the hand grip.

2. The attachment handle according to claim 1, wherein at least one of the first ring and the second ring comprises a clasp to allow removal of the at least one of the first ring and the second ring from the tension member.

3. The attachment handle according to claim 1, wherein the flexible tension member is foldable about the hand grip such that openings of each of the first and second rings are alignable.

4. The attachment handle according to claim 1, wherein the flexible tension member comprises:

a first end portion fed through an opening of the first ring and folded over against the flexible tension member; and a second end portion fed through an opening of the second ring and folded over against the flexible tension member.

5. The attachment handle according to claim 4, wherein the folded-over first and second end portions are secured to the flexible tension member with stitching.

6. The attachment handle according to claim 1, wherein the flexible tension member is a flat strip of fabric.

7. The attachment handle according to claim 1, wherein the first shoulder and the second shoulder are curved surfaces.

8. The attachment handle according to claim 1, wherein the first shoulder and the second shoulder are beveled surfaces.

9. A cable exercise machine comprising:

a clip;

a first attachment handle comprising:

a flexible tension member;

a first ring secured to a first end of the flexible tension member;

a second ring secured to a second end of the flexible tension member; and a hand grip having a bore surrounding the flexible tension member, the hand grip comprising a first flange located at a first end of the hand grip and a second flange located at a second end of the hand grip, wherein the hand grip is slideable along the flexible tension member between the first and second rings;

wherein the hand grip defines a first shoulder at the first end of the hand grip adjacent to the first flange and a second shoulder at the second end of the hand grip adjacent to the second flange; and a second attachment handle identical to the first attachment handle, wherein one of the rings of each of the first and second attachment handles are connected to the clip.

10. The cable exercise machine according to claim 9, wherein the hand grip of each attachment handle comprises a tapered gripping surface such that a circumference of the gripping surface decreases toward one of the first or second ends of the hand grip.

11. The cable exercise machine according to claim 9, wherein at least one of the first ring and the second ring of each attachment handle comprises a clasp to allow removal of the at least one of the first ring and the second ring from the tension member.

12. The cable exercise machine according to claim 11, wherein the gripping surface of each attachment handle is tapered such that a circumference of the gripping surface decreases in a direction away from the clip.

13. The cable exercise machine according to claim 9, wherein the flexible tension member of each attachment handle comprises:

a first end portion fed through an opening of the first ring and folded over against the flexible tension member; and a second end portion fed through an opening of the second ring and folded over against the flexible tension member.

14. The cable exercise machine according to claim 13, wherein the folded-over first and second end portions of each attachment handle are secured to the flexible tension member with stitching.

15. The cable exercise machine according to claim 9, wherein the flexible tension member of each attachment handle is a flat strip of fabric.

16. The cable exercise machine according to claim 9, wherein the first shoulder and the second shoulder of each attachment handle are curved surfaces.

17. The cable exercise machine according to claim 9, wherein the first shoulder and the second shoulder of each attachment handle are beveled surfaces.

18. An attachment handle for an exercise machine, comprising:

a flexible tension member;

a first ring secured to a first end of the flexible tension member;

a second ring secured to a second end of the flexible tension member;

and a hand grip having a bore surrounding the flexible tension member, the hand grip comprising a first flange located at a first end of the hand grip and a second flange located at a second end of the hand grip, wherein the hand grip is slideable along the flexible tension member between the first and second rings, wherein the hand grip defines a first shoulder at the first end of the hand grip adjacent to the first flange and a second shoulder at the second end of the hand grip adjacent to the second flange, the first shoulder and the second shoulder having the same diameter, and wherein the hand grip comprises a tapered gripping surface such that a circumference of the gripping surface decreases toward one of the first or second ends of the hand.

* * * * *